US005311646A

United States Patent [19]

Eischen, Sr.

[11] Patent Number: 5,311,646

[45] Date of Patent: May 17, 1994

[54] BAG CLOSURE ELEMENT

[76] Inventor: Clem G. Eischen, Sr., 601 NE. 67th Pl., Portland, Oreg. 87230

[21] Appl. No.: 9,273

[22] Filed: Jan. 26, 1993

[51] Int. Cl.[5] ..... B65D 77/00

[52] U.S. Cl. ..... 24/30.5 S; 24/30.5 R; 24/563

[58] Field of Search ..... 24/30.5 S, 30.5 R, DIG. 28, 24/571, 570, 517, 555, 563, 545, 335, 336, 560, 543, 11 P, 11 R; 383/71, 72; 248/110, 113; 285/902

[56] References Cited

U.S. PATENT DOCUMENTS

| | | | |
|---|---|---|---|
| 562,566 | 6/1896 | Baynes | 248/113 |
| 1,830,014 | 11/1931 | Brady | 24/30.5 R |
| 2,133,068 | 10/1938 | Wiegman . | |
| 2,981,990 | 5/1961 | Balderree, Jr. | 24/30.5 S |
| 3,294,229 | 12/1966 | McConnell et al. | 24/563 |
| 3,295,812 | 1/1967 | Schneider et al. | 24/335 |
| 3,874,713 | 4/1975 | Myers | 285/902 |
| 4,509,231 | 4/1985 | Paxton | 24/30.5 R |
| 4,536,924 | 8/1985 | Willoughby | 24/563 |
| 4,574,983 | 3/1986 | Fatkin | 24/30.5 R |
| 4,694,542 | 9/1987 | Koppe | 24/30.5 S |
| 4,760,624 | 8/1988 | Fish | 24/30.5 S |
| 4,783,886 | 11/1988 | Koppe . | |
| 4,896,366 | 1/1990 | Oxman | 383/71 |

*Primary Examiner*—Victor N. Sakran
*Attorney, Agent, or Firm*—Kolisch, Hartwell, Dickinson, McCormack & Heuser

[57] ABSTRACT

A bag closure element comprising a sheet-like body, the body including two spaced expanses, each expanse including an opening to grip an object passed therethrough, a fold region positioned between the expanses, and the expanses extending at an acute angle with respect to each other when an object is gripped. The closure element also includes slits providing access to the openings. The object gripped by the openings is preferably the gathered or twisted portion of a plastic bag, which extends linearly between and through the openings.

15 Claims, 1 Drawing Sheet

FIG.1
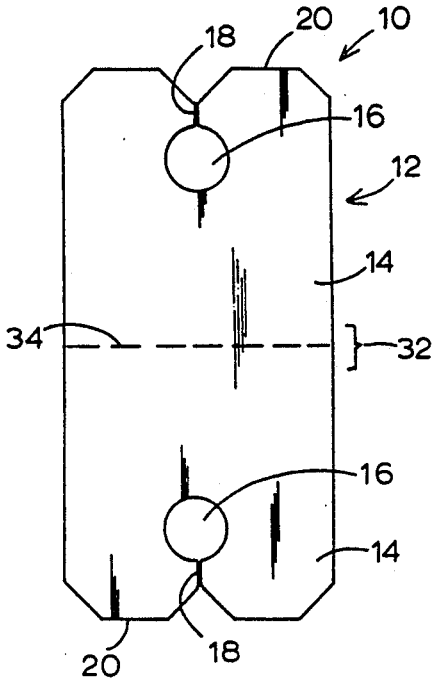
FIG. 2
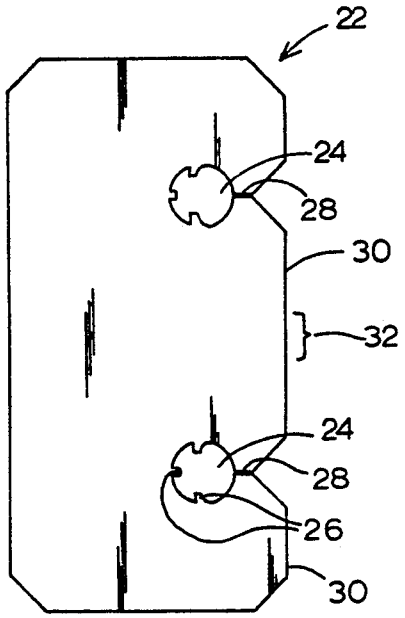
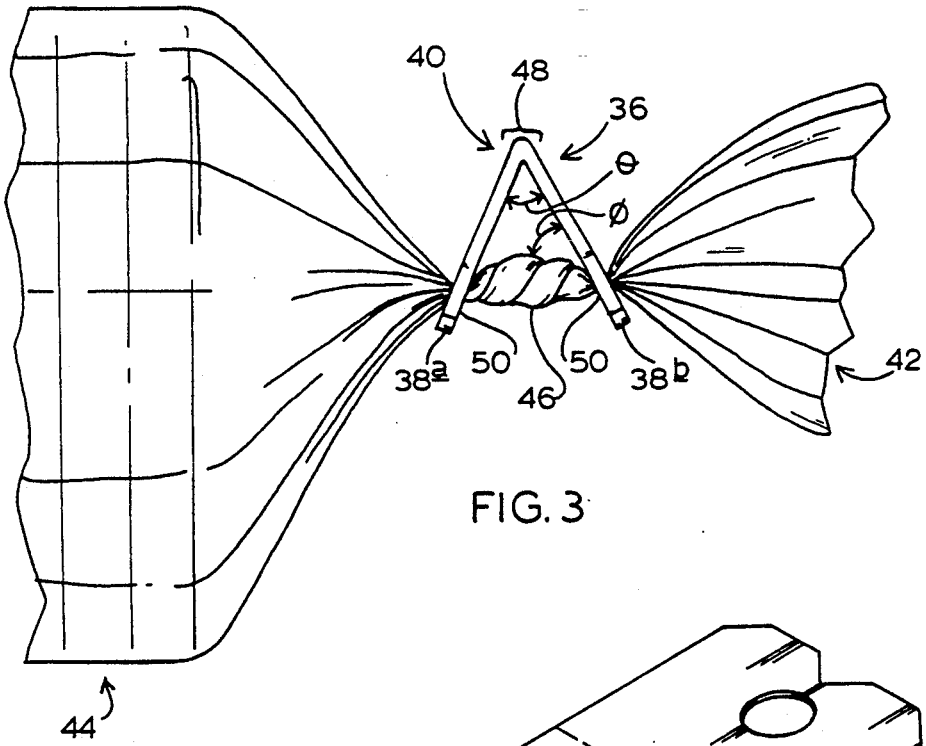
FIG. 3
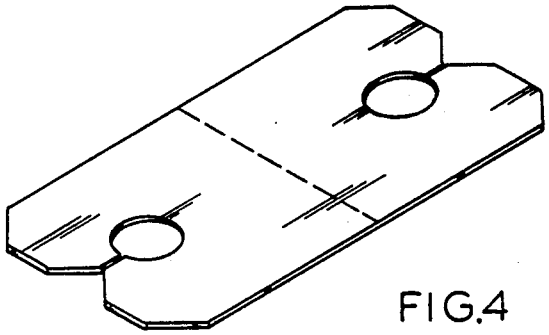
FIG.4

BAG CLOSURE ELEMENT

BACKGROUND AND SUMMARY OF THE INVENTION

This invention relates to a new and improved bag closure element, and particularly to a folded bag closure element which insures an air-tight seal of a bag.

In the packaging of fruits, vegetables, breads, and bulk goods, plastic bags are commonly used. Conventionally, closure elements having a single hole and a corresponding single access slit are secured about the gathered end portion of a plastic bag. This arrangement does not result in an air-tight seal of the bag because the gathered portion is loosely held at only one point. This problem is solved only if the hole is small compared to the gathered plastic, which makes the closure element difficult to place on the bag. In response, bag closure elements having two holes and two corresponding access slits were developed to hold a gathered section of a bag.

U.S. Pat. No. 2,981,990, entitled "BAG CLOSURE SEAL" issued to Balderree, and U.S. Pat. No. 4,760,624, entitled "CLOSURE/HOLDER WITH ACCESS SLIT", issued to Fish, both disclose closure elements having two holes and two corresponding access slits (see Balderree at FIG. 3, Fish at FIG. 8). Both patents disclose a flat closure element through which the gathered portion of a plastic bag is bent upwardly through one hole, and then downwardly through the second hole. However, this bending of the bag required by the prior art has several disadvantages.

In using flat double-holed prior art closure elements the gathered end of the bag must be manipulated in several different directions to secure the bag within the two holes. If the end of the bag is twisted, instead of gathered, such manipulation is more difficult due to the rigidity of the twisted portion. Another disadvantage of using prior art devices is that the gathered portion of a bag must be manipulated into and out of each hole separately, a labor intensive task.

Accordingly, it is an object of the present invention to provide a bag closure element which facilitates one-step securing and one-step removal of the closure element from a bag.

It is another object of the present invention to provide a bag closure element which requires less manipulation of the plastic bag than does the prior art.

It is a further object of the present invention to provide a bag closure element which facilitates substantially air-tight sealing of the twisted end of a bag.

Other objects of the present invention will become apparent from the detailed description to follow, taken in conjunction with the accompanied drawings.

BRIEF DESCRIPTION OF THE DRAWINGS

FIG. 1 is a top view of the preferred embodiment of the bag closure element;

FIG. 2 is a top view of another embodiment of the closure element;

FIG. 3 shows the closure element in use, secured on the twisted end portion of a bag; and FIG. 4 is a perspective view of the closure element shown in FIG. 1.

DESCRIPTION OF THE PREFERRED EMBODIMENT

FIG. 1 illustrates a bag closure element 10 in accordance with the present invention, having sheet-like body 12, manufactured of flexible or pliant, resilient material. For instance, the body may be made of conventional plastics, or cut from a thin cardboard sheet.

Body 12 includes expanses, 14, each of which is formed with an opening, such as a hole, or orifice, 16. In the preferred embodiment, shown in FIG. 1, the holes are round, and slits 18 provide access to the holes from ends 20 of the body.

In another embodiment, shown in FIG. 2, closure element 22 includes holes 24, which include gripping teeth 26. Slits 28 are positioned on side edge 30 to access the holes.

The holes and access slits can be manufactured in different sizes to accommodate various sized bags. In addition, the sheet-like body can be manufactured in various thicknesses to accommodate a variety of uses.

Positioned between the expanses is a fold region, 32. In the preferred embodiment, the fold region further includes a fold line, 34. As shown in FIG. 3, in use, the sheet-like body is folded along its fold line to create a "V" type shape 36, whereby the intersection of expanses 38*a* and 38*b* defines angle $\theta$. In the preferred embodiment, $\theta$ is approximately 45 degrees when the closure element is securing a bag. In other embodiments the sheet-like body can be bent or folded in a "U" type shape or can include two fold lines to give a square type shape (not shown) when securing a bag. In another embodiment the body is reversely turned so that the two expanses are positioned opposite each other. The body further includes an intermediate expanse which joins the two opposed expanses.

FIG. 3 shows a folded bag closure element 40 according to the present invention securing an end 42 of a bread bag 44 in an improved air-tight seal. As known by those skilled in the art, the closure element can be used to secure bags used for fruits, vegetables, breads, meats, toys, refuse, or the like. The improved air-tight seal lengthens the shelf life of perishable products. The improved air-tight seal also allows the storing of dissimilar articles, such as onions and apples, in separate bags near each other without threat of contamination. In addition, the invention prolongs the freshness of goods contained in frequently re-opened bags, such as bread loaves.

The present invention facilitates an improved air-tight seal of a bag by securely holding or gripping a twisted portion 46, linearly between the expanses. The invention has several advantages due to this linear arrangement of the twisted portion and due to the folded arrangement of the sheet-like body.

Less manipulation of the bag is required than with prior art closure elements because the bag's twisted region is secured linearly between the expanses. Prior art devices required that the gathered portion of a bag be bent around the contours of the flat closure element, a labor intensive task. On the other hand, the closure element of the present invention is secured about a bag as the bag end is held still.

Opposed surfaces or expanses 14, when placed on the object to be gripped, occupy different planes thereby creating a space between the openings. The space is necessary to maintain the twisted portion from unraveling, thereby ensuring an air-tight closure of the bag.

Another advantage is that because less manipulation of the bag end is required to secure the bag within the closure element, the bag end can be twisted more tightly than bags secured in prior art devices. The tightly twisted portion of the bag does not unravel, ensuring an improved air-tight seal.

Another advantage of the present invention is one-step securing of the closure element on a bag. The fold region allows the user to pinch the expanses together ($\theta=0$ degrees) so that the holes in each expanse are axially aligned and adjacent each other. In one movement, the user can secure both holes about the twisted portion of the bag by pushing both access slits over the gathered end portion of the bag. The user's thumb and forefinger can then be removed from the closure element. The expanses move apart due to the resilient material of the sheet-like body, enlarging angle $\theta$, so that the twisted region of the bag is securely held taunt by the expanses, which creates the improved air-tight seal. In addition, as $\theta$ increases, angle $\phi$, positioned between the each expanse and the linearly arranged twisted portion, decreases. As $\phi$ decreases, the cross-sectional area of the hole through which the twisted portion passes becomes smaller. Due to the decrease in cross-sectional area of the hole, the bag is more tightly held as the expanses move apart. Thus, along with one-step securing of the closure element on the bag, the invention has the advantage of self-tightening on the plastic bag.

A further advantage of the present invention is one-step removal. The user can pinch the expanses together, thereby decreasing $\theta$, so that the holes in the expanses are axially aligned and adjacent. With the holes positioned adjacent each other, the user can then remove the twisted region from both holes and access slits in one motion. In prior art devices, the user was required to remove the plastic bag from each hole separately.

Another advantage of the present invention is that the user's thumb and forefinger are ideally positioned on the closure element for removing the element from the bag's twisted region. In the preferred embodiment a user's thumb and forefinger are positioned at fold region 48 (shown in FIG. 3) on the opposite side of the bag's twisted region from slits 50. Thus, when the user pulls the closure element away from the twisted region, the access slits are ideally positioned below the twisted region and the twisted region is forced through the slits.

Although the invention has been described with reference to a preferred embodiment and a second embodiment, other embodiments can achieve the same result. Variations and modifications of the present invention will be obvious to those skilled in the art and it is intended to cover in the appended claims all such modifications and equivalence.

I claim:

1. The combination of a bag having a gathered portion closing off the bag and a closure element holding the gathered portion comprising:

a sheet-like body including two spaced expanses;

each expanse having a constricted opening to grip a bag passed therethrough, each expanse accessed by a slit in the body, the slit extending from each opening to a perimeter of the body; and the expanses extending at an acute angle with respect to each other such that the body is bent along a central fold region when gripping the bag, the fold region extending transversely between the openings such that the fold region does not intersect the openings.

2. The closure element of claim 1 wherein the body is pliant.

3. The closure element of claim 1 wherein the body is resilient.

4. The closure element of claim 1 wherein the slits are positioned on opposing ends of the body.

5. The closure element of claim 1 wherein the slits are positioned on a side edge of the body.

6. The combination of a bag having a gathered portion closing off the bag and a closure element holding the gathered portion;

the closure element comprising a sheet-like body folded along a central fold region with end expanses positioned on opposite sides of said central fold region;

an opening completely contained within each of the expanses such that the central fold region and extending transversely between each of said openings and does not intersect the openings, the openings being constricted and accessed by a slit in each expanse; and the gathered portion of the bag extending linearly between and through the openings such that the bag is airtight.

7. The closure element of claim 6 wherein the body is pliant.

8. The closure element of claim 6 wherein the body is resilient.

9. The closure element of claim 6 wherein the slits are positioned adjacent opposite ends of the body.

10. The closure element of claim 6 wherein the slits are positioned on a side edge of the body.

11. A bag closure element comprising:

a sheet-like body including a central fold region;

the body further including two spaced expanses positioned on opposite sides of the central fold region;

the expanses each including a constricted opening to grip a bag passed therethrough, the openings positioned such that the fold region extends transversely between the openings and does not intersect the openings, the openings each accessed by a slit extending from a perimeter of the body to the opening; and the expanses extending at an acute angle with respect to each other when the bag is gripped.

12. The closure element of claim 11 wherein the body is pliant.

13. The closure element of claim 11 wherein the body is resilient.

14. The closure element of claim 11 wherein the slits are positioned on opposing ends of the body.

15. The closure element of claim 11 wherein the slits are positioned on a side edge of the body.

* * * * *